US008622191B2

(12) United States Patent
Leibu et al.

(10) Patent No.: US 8,622,191 B2
(45) Date of Patent: Jan. 7, 2014

(54) DETECTION DEVICE

(75) Inventors: Mark H. Leibu, St. Louis, MO (US); Ronald A. Hoormann, St. Charles, MO (US); Ronald E. Lovall, St. Louis, MO (US); Steven M. Costello, O'Fallon, IL (US)

(73) Assignee: Coin Acceptors, Inc., St. Louis, MO (US)

( * ) Notice: Subject to any disclaimer, the term of this patent is extended or adjusted under 35 U.S.C. 154(b) by 0 days.

(21) Appl. No.: 13/192,433

(22) Filed: Jul. 27, 2011

(65) Prior Publication Data

US 2012/0138420 A1 Jun. 7, 2012

Related U.S. Application Data

(60) Provisional application No. 61/368,137, filed on Jul. 27, 2010.

(51) Int. Cl.
*G07D 5/02* (2006.01)

(52) U.S. Cl.
USPC ..... 194/332

(58) Field of Classification Search
USPC ..... 194/332, 302, 334, 214, 303, 337, 338; 73/163; 382/136
See application file for complete search history.

(56) References Cited

U.S. PATENT DOCUMENTS

| | | | | |
|---|---|---|---|---|
| 6,021,882 | A * | 2/2000 | Juds et al. | 194/212 |
| 6,305,523 | B1 * | 10/2001 | House et al. | 194/317 |
| 2004/0108183 | A1 * | 6/2004 | Sugata et al. | 194/328 |

* cited by examiner

*Primary Examiner* — Mark Beauchaine
(74) *Attorney, Agent, or Firm* — Polster Lieder Woodruff & Lucchesi, L.C.

(57) ABSTRACT

A device for sensing predetermined characteristics of an object such as a coin or a token in order to determine its validity or genuineness and in some cases its denomination, the device including a combination of optical and electromagnetic sensors which operate together along a coin path and capable to analyze the coin or token in different positions so that if there are multiple holes or rings of transparent material they can be sensed and used to determine the coin or token's validity and denomination.

13 Claims, 9 Drawing Sheets

DETECTION DEVICE

The present application claims priority to U.S. Provisional Patent Application Ser. No. 61/368,137 filed Jul. 27, 2010. The contents of said application are incorporated herein by reference.

BACKGROUND OF THE INVENTION

Vending machines typically include devices capable of validating and accepting money like coin changers, bill acceptors, credit card readers, etc. Coin acceptor devices function to authenticate and denominate each of the coins inserted into the vending machine. Known coin detection and validation devices utilize various techniques and methods which include optical size detection and metallic content or characteristic detection. Examples of such coin detection devices are disclosed in U.S. Pat. Nos. 4,625,852, 4,646,904, 5,662,205, 5,673,781, 6,230,870. These patents relate to coin detection, validation and denomination and include some features which, in the general sense, relate to the present invention. All of these patents are assigned to the assignee of the present invention.

Typically, the coin acceptor has one coin inlet funnel for all coin inputs and which directs coins toward a sloped coin track along which are located optical and magnetic sensors to validate acceptable coinage and reject spurious materials. After being sensed for validity and denomination, the coin is directed in a number of directions. Valid coins are directed to coin inventory tubes, used for coin payback, or a cash box. Invalid denominations or counterfeit coins are directed to a coin return chute.

In order to properly sense the validity and denomination of the coin, a serpentine path directs the coin toward the beginning of a stainless steel validation rail. The validation rail will both stabilize the coin and guide it past the validation sensors. The rail combined with an inward lean will maximize coin lean against the sensors.

Coin validation begins once the coin acceptor recognizes a coin is passing by the optical and magnetic sensors. After proper coin validation, a series of decision gates actuated by solenoids will control the proper routing of the coin.

Coins containing holes or transparent portions or containing portions made from dissimilar materials represent a difficulty for prior art coin detectors. Coins with apertures of any kind allow light pass through the coin as the coin rolls past an optical sensors and coins having portions of dissimilar metals cause the magnetic sensors to fail to generate a consistent or expected waveform.

The prior art devices therefore do not address the problem of validating coins made of more than one different material with holes that are symmetrical or non-symmetrical, apertures or rings of transparent material.

Accordingly, it is desirable and advantageous to provide a coin detection device having optical and electromagnetic sensors and associated circuits capable of accurately authenticating and accepting coins of different denominations by measuring the unique characteristics of holes, apertures and transparent rings located on the coin.

SUMMARY OF THE INVENTION

A coin detection device for determining a size of a coin and a size of at least one aperture hole in the coin while the coin is traveling along a coin track, the device comprising a first inductive sensor array positioned along the coin track and/or a first optical sensor array positioned along the coin track, a processing circuit connected to the optical and inductive sensor arrays, each of the sensors providing an output signal to the processing circuit and the processing circuit determining a size of the coin and a size of at least one aperture hole in the coin based upon output signal from each of the optical and inductive sensor arrays.

DETAILED DESCRIPTION OF THE PREFERRED EMBODIMENTS

The coin detection device of the present invention is capable of determining a physical configuration of coins containing apertures or transparent portions and/or an arrangement of dissimilar metals as well as the size of those holes, apertures or transparent portions or the size of the portions containing dissimilar metals. This is accomplished with a special arrangement of optical and inductive sensors positioned along the coin track each of the sensors for providing an output signal to an electrical circuit. By examining the waveforms created by the optical and inductive sensors and comparing the waveform to expected waveforms for an acceptable coin, the coin denomination and validity can be determined.

In one specific embodiment, a coin detection device for detecting a characteristic of a coin comprises a processing circuit, an arrangement of optical sensors and an arrangement of electromagnetic sensors. Each of these arrangements of sensors is connected to a processing circuit. The optical sensors produce a size related output signal and the magnetic sensors provide an output signal to the processing circuit indicative of the interaction of an electromagnetic field with the coin. The optical and magnetic sensors being in a special location relationship to each other based on the size of the coin and the size and location of the holes or transparent portions of the coin, and the processing circuit for determining whether the coin is acceptable based upon a comparison of the output signals.

Another form of the present invention is a metal detector which comprises a first array of optical sensors and a second array of inductive elements, or magnetic sensors, the first and second arrays being connected to processing circuits, the arrays being in a mechanical relationship to each other, the first and second circuits each providing an output signal to the processing circuit, the output signals being produced by the presence of a metallic object and the processing circuit for detecting a characteristic of the metallic object based upon a ratio of the a diameter size and an aperture size to determine a coin's validity.

Figure 1:
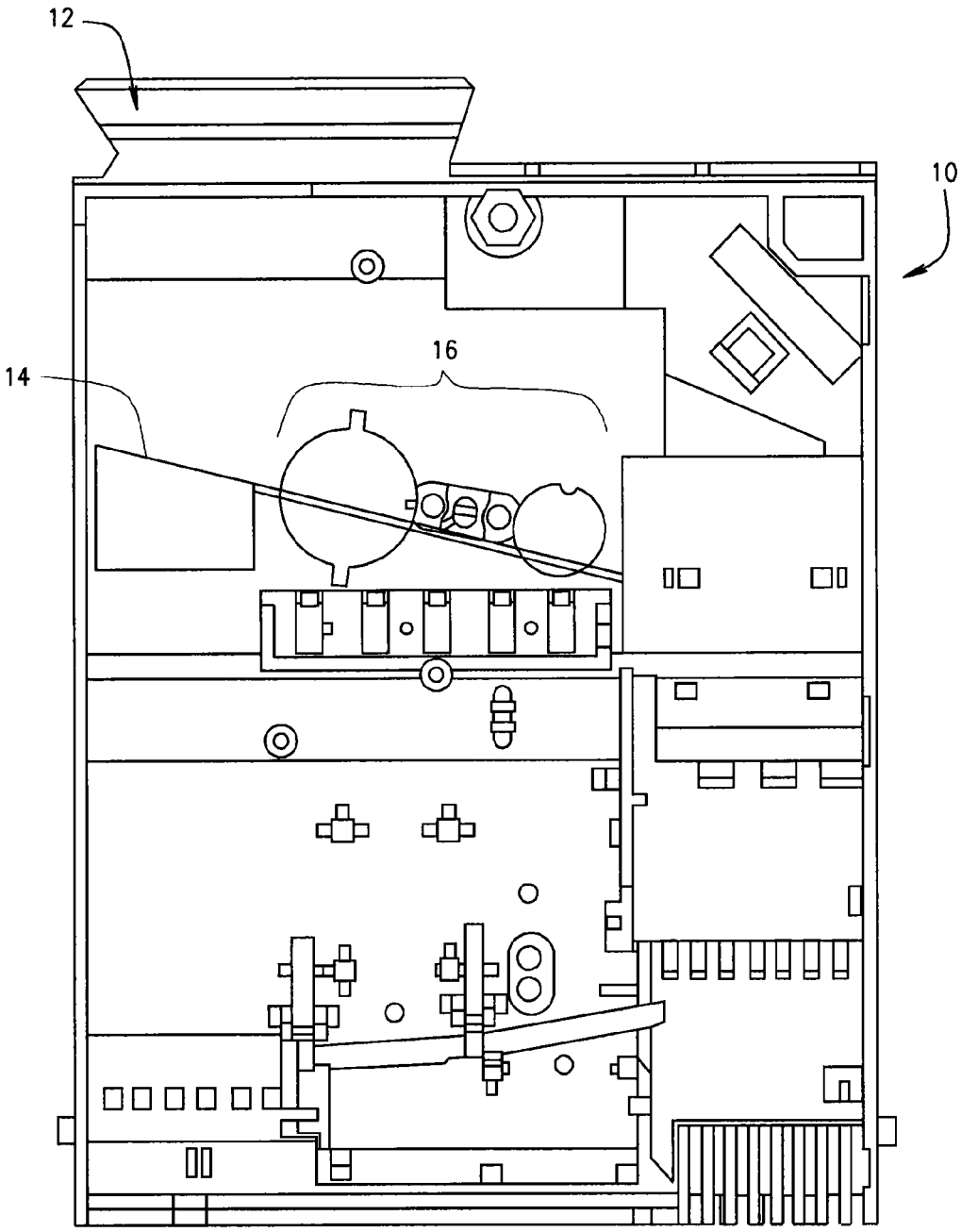
FIG. 1 is a partial plan view of the internal portion of a coin acceptor according to an embodiment of the present invention.

Referring now to the drawings, FIG. 1 shows a coin acceptor device 10 comprising a coin entry portion 12, a coin track portion 14, and a coin sensor portion 16. When the coin is inserted into the coin entry portion 12 of the coin acceptor device 10, it moves through the device 10 until it rolls down the coin track portion 14 and past the coin detector portion 16. The coin detector portion 16 comprises a plurality of electromagnetic and optical components, as discussed below, for detecting the denomination and validity of the coin.

Figure 2:
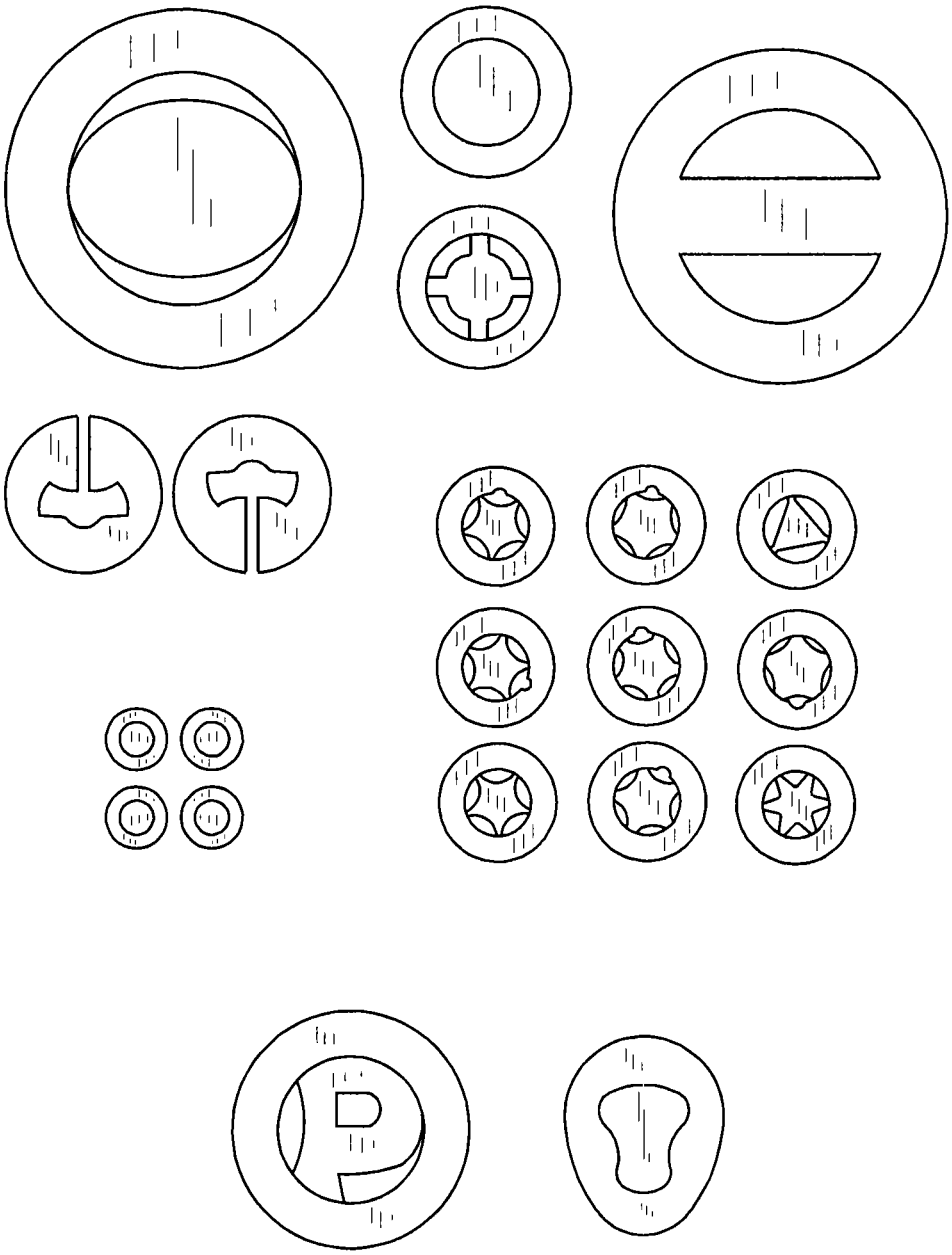
FIG. 2 is shows examples of actual coins containing apertures or dissimilar metals.

FIG. 2 shows exemplary coins and tokens that include voids and openings which present difficulty for coin acceptors of the prior art to determine denomination and validity due to those voids.

Figure 3:
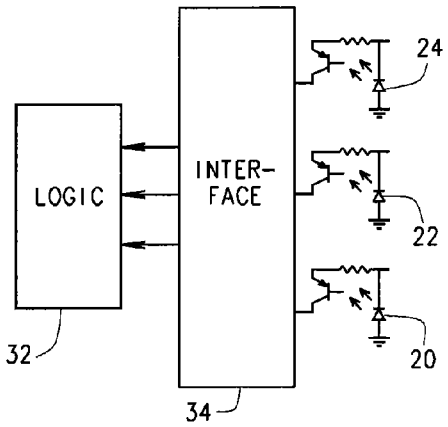
FIG. 3 is a schematic representation of optical sensors according to an embodiment of the present invention.

FIG. 3 is an electrical schematic showing an embodiment for an arrangement of optical sensors in accordance with the present invention. In the exemplary arrangement three light emitting diodes (LEDs) 20, 20', and 20" are arrangement proximate to three phototransistors 26, 26', and 26" which detect light from the LEDs 20, 20' and 20". The LEDs 20, 20', and 20" may emit light in the visible or invisible range of the spectrum; however, the LED must be matched to the sensible range of the phototransistors 26, 26' and 26". Each corresponding pair of LEDs 20, 20' and 20" and phototransistor 26, 26', 26" are referred to herein as an optical sensor. The state of the phototransistors is transmitted to a logic circuit 32 via an interface circuit 34. Physically a LED and its corresponding phototransistor could be located across a coin track or coin path from one another or on a single side of the coin path with the light emitted by the LED being redirected to the phototransistor by a mirror. It will be understood by one of ordinary skill in the art while the arrangement of optical sensors is shown as comprising three sensors for purposes of illustration any number of a plurality of optical sensors could be utilized to accomplish the arrangement. The logic circuit 32 and interface circuit 34 will transform the sensors' output created by the passage of a coin into logical signals, as discussed below.

Figure 4:
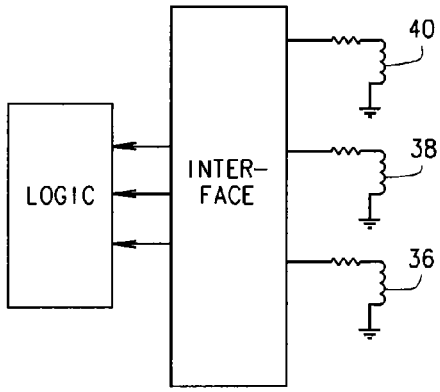
FIG. 4 is a schematic representation of electromagnetic sensors according to an embodiment of the present invention.

FIG. 4 is an electrical schematic showing an embodiment for an arrangement of magnetic sensors comprising sensitive coils 36, 36' and 36" whose electromagnetic field interacts with coins that pass by the arrangement of sensors. Coils can be arranged on one or either side of the coin track. The coils may be powered by a tank circuit, an oscillator circuit or a pulsing device to generate the electromagnetic field. Like the optical sensors, above, the state of the magnetic sensors 36, 38 and 40 is transmitted through the interface 34 and to the logic circuit 32. It will be understood by one of ordinary skill in the art while the arrangement of electromagnetic sensors is shown as comprising three sensors for purposes of illustration any number of a plurality of optical sensors could be utilized to accomplish the arrangement. The logic circuit 32 and interface circuit 34 will transform the sensors' output created by the passage of a coin into logical signals, as discussed below.

Figure 5:
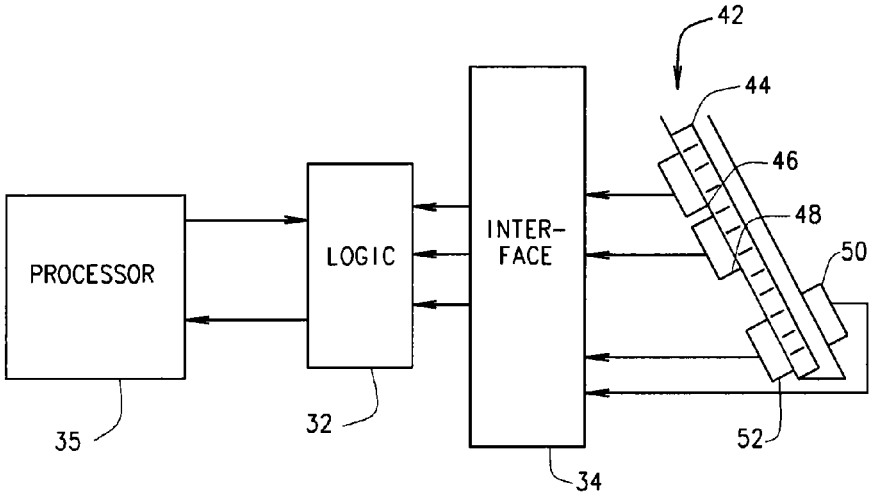
FIG. 5 is a schematic representation of an embodiment of the present invention.
Figure 6:
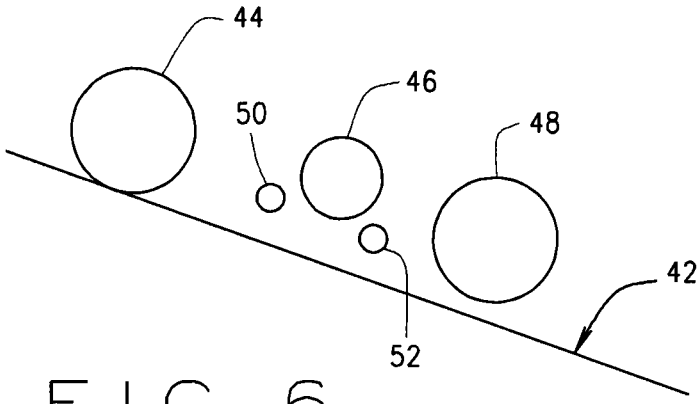
FIG. 6 is a schematic representation of an embodiment of the present invention.

As shown in FIGS. 5 and 6, a coin track 42 of a coin acceptor routes a coin 44 past the arrangements of optical and electromagnetic sensors 46, 48, 50, 52. The optical sensors comprise pairs of LEDs 20 and phototransistors 26, and the electromagnetic sensors comprise coils 36. The arrangements of sensors may be located on a single side of the coin, as in sensors 46, 48 and 52, or on opposite sides of the coin as in sensors 50 and 52.

Figure 7A:
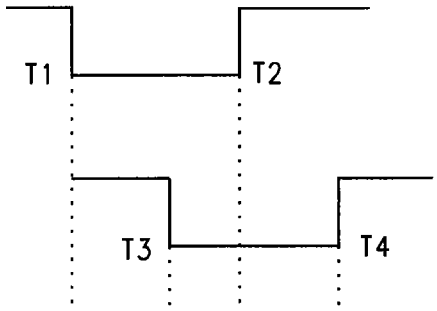
FIG. 7 is a graphical representation of waveform outputs from optical sensors and magnetic sensors according to an embodiment of the present invention.
Figure 7B:
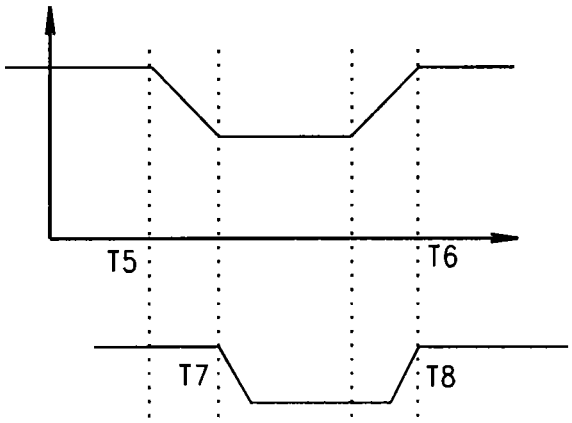

FIGS. 7*a* and 7*b* show waveforms created by a coin passing by an optical sensor (FIG. 7*a*) and a magnetic sensor (FIG. 7*b*). In the case of FIG. 7*a*, point T1 represents a detection of the leading edge of a coin passing by an optical sensor and point T2 represents a trailing edge of a coin passing by the same optical sensor. Point T3 represents the leading edge of the same coin passing another optical sensor within the same optical sensor arrangement but located at a different point along the same coin path 42 and point T4 represents the trailing edge of that coin from the same optical sensor.

In the case of FIG. 7*b*, point T5 represents a detection of the leading edge of a coin passing by an electromagnetic sensor and point T6 represents a trailing edge of a coin passing by the same electromagnetic sensor. Point T7 represents the leading edge of the same coin passing another electromagnetic sensor within the same electromagnetic sensor arrangement but located at a different point along the same coin path 42 and point T8 represents the trailing edge of that coin from the same electromagnetic sensor.

Figure 8:
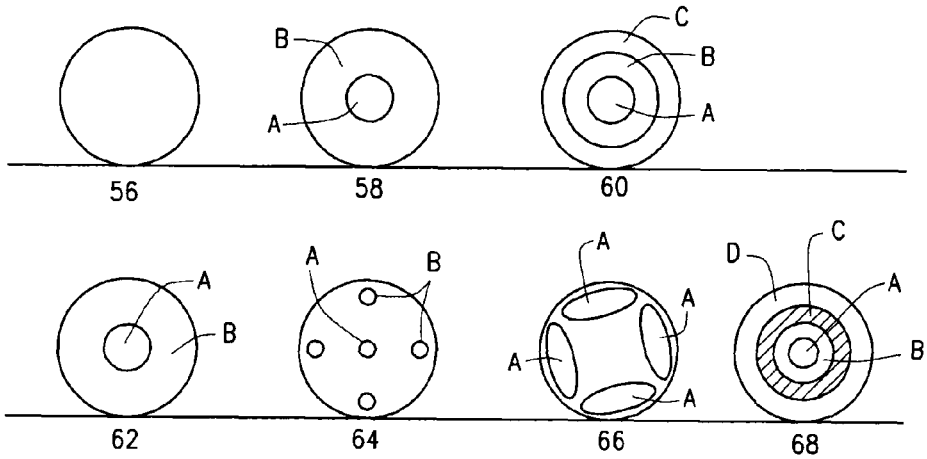
FIG. 8 is a schematic representation of representative types of coins and tokens that can be validated according to an embodiment of the present invention.

FIG. 8 shows schematically examples of coins that may be validated and denominated using the present invention. Coin 56 is a solid coin made of single metal or alloy. Coin 58 is a solid coin having a center A made of one alloy and an outer portion made of a different alloy B (which may also be a of same or different color). Coin 60 is a solid coin having a center A and two circumferential outer rings B and C made from different alloys. Coin 62 comprises a central aperture A defined by an outer ring B. Coin 64 defines a central aperture A surrounded by four regularly spaced apertures B. Coin 66 defines four ovular and regularly spaced apertures. Coin 68 has a center A made from a first alloy, a surrounding ring B made from a second alloy, a transparent ring C, and an outer ring made from yet a third alloy D.

Figure 9:
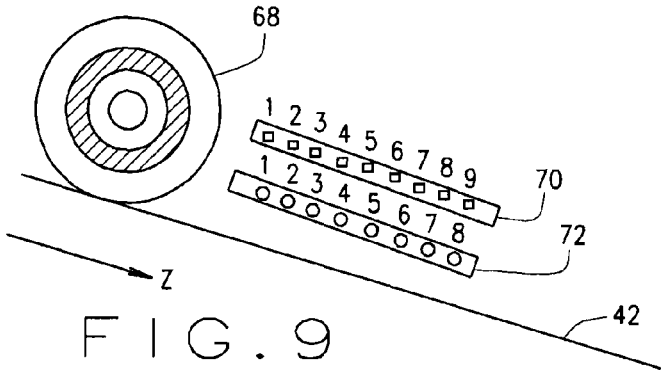
FIGS. 9-18 are schematic representations of coins passing sensor arrays along a coin path according to an embodiment of the present invention.

FIG. 9 shows schematically the coin path 42 and the coin 68 moving down the track 42 in a direction Z. An array of optical sensors 70 and an array 72 of electromagnetic sensors 72 detect coin 68's leading and trailing edges, as well as reacts the coin 68's various alloys and transparent sections. The optical sensor array 70 and magnetic sensor array 72 are arranged in a horizontal and parallel position with respect to the coin path 42. Each optical sensor and each electromagnetic sensor will create the same waveform in reaction to the passing coin 68, though each waveform will be out of phase in the time domain due to the linear placement of the sensors within the along the coin path 42. If the coin (as in the coin 68) is bilaterally symmetrical along any bisecting diameter of the coin, the phase separation of the waveforms can further be used to determine the diameter of the coin 68.

Figure 10:
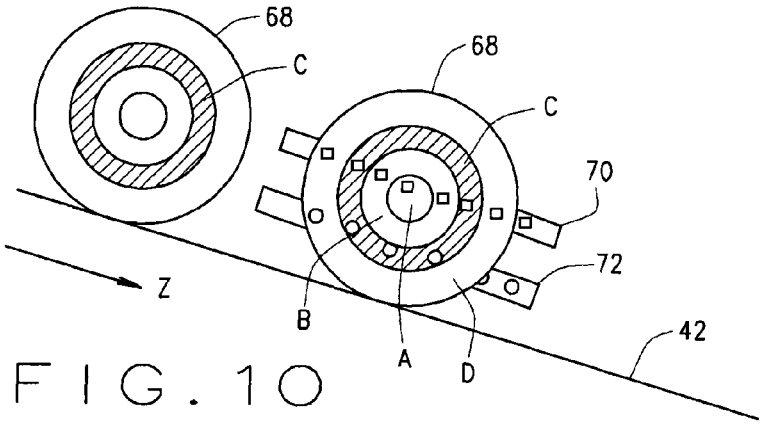

FIG. 10 shows schematically the same elements as depicted in FIG. 9 but that the coin 68 is now located in the proximity of the sensors 70, 72. The optical sensors 70 are blocked as soon as the front edge of the coin reaches them and unblocked as soon as the transparent portion C of the coin 68 arrives or the trailing edge of the coin 68 passes. The magnetic sensors 72 will react differently to the alloy of the center A of the coin 68, the ring B of the coin 68, the ring C of the coin and the ring D of the coin, thereby creating a unique waveform as the coin passes. As such, each sensor with the optical array 70 and the electromagnetic array 72 will generate waveforms, as described in FIGS. 7*a* and 7*b*.

Figure 11:
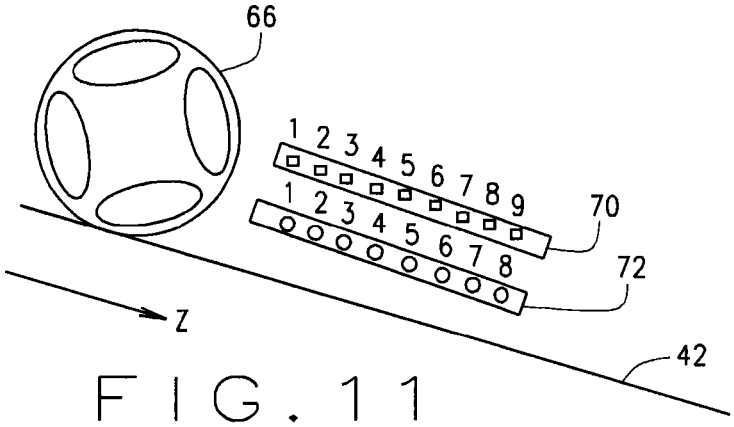
Figure 12:
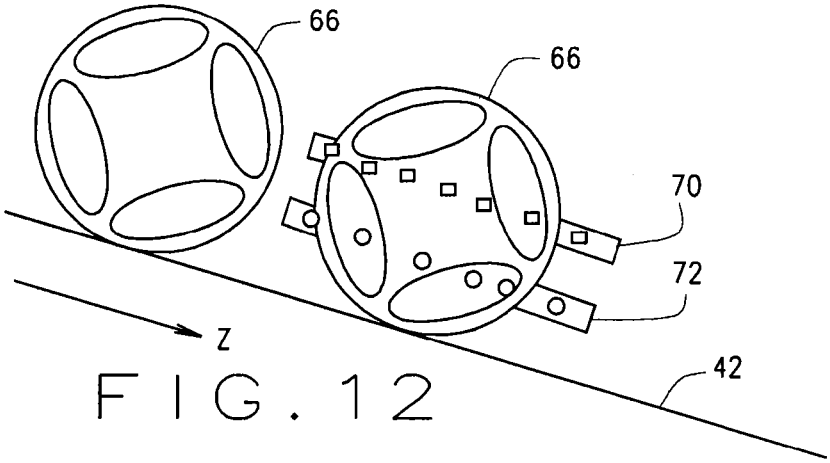

FIGS. 11 and 12 are similar to FIGS. 9 and 10, but show the passage of coin 66 comprising a single alloy but multiple apertures. The optical sensors 70 are blocked as soon as the front edge of the coin 66 reaches them and unblocked as soon as the transparent portion C of the coin 66 arrives, apertures passes or the trailing edge of the coin 66 passes. The magnetic sensors 72 will react differently to the alloy of the coin 66 or the apertures of the coin 66 as they pass, again creating a unique waveform as the coin 66 passes.

Figure 13:
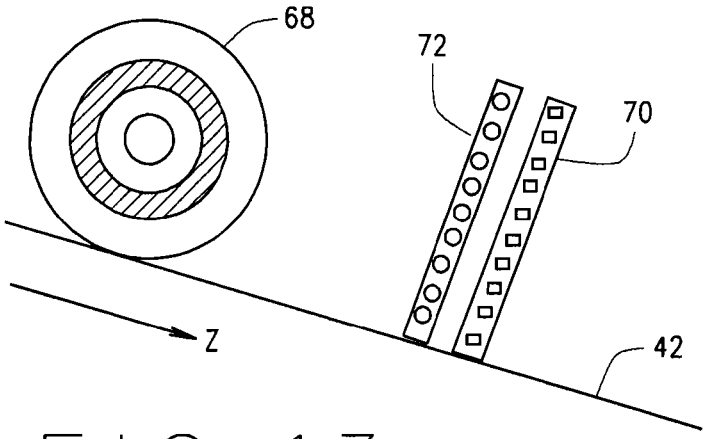
Figure 14:
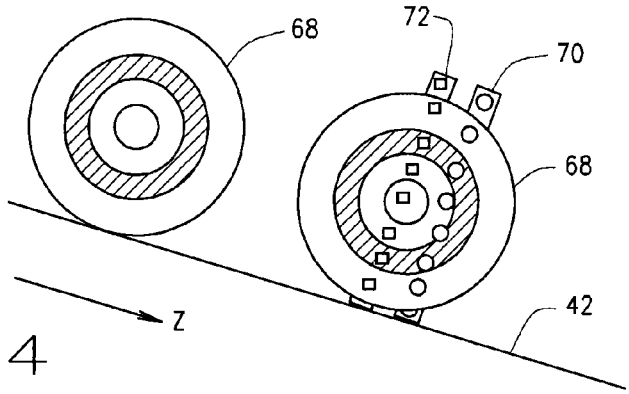

In alternative embodiment, FIG. 13 shows schematically the coin track 42 and the coin 68 moving down the track 42 in a direction Z. An array of optical sensors 70 and an array of magnetic sensors 72 are placed in a vertical or perpendicular arrangement with respect to the coin path 42. FIG. 14 shows schematically the same elements as depicted in FIG. 13 except that the coin 68 is now located in the proximity of the sensor array 70, 72. The optical sensors of the optical sensor array 70 will be blocked as soon as the front edges of the coin riches them and unblocked as soon as the transparent portion of the coin 68 or the trailing edge of the coin 68 arrives. The magnetic sensors will be react differently to the center of the coin and various rings, as they are made of different materials. Every sensor will generate waveforms as described with respect to FIGS. 7*a* and 7*b*. The primary difference between the embodiment of FIGS. 9 and 10 and FIGS. 13 and 14 is with respect to the embodiment of FIGS. 9 and 10, each sensor is expected to have a waveform of generally the same form but not in phase.

With respect to the embodiment of FIGS. 13 and 14, sensors of the arrays 70 and 72 which are equidistant from coin's center can be expected to have the same waveform but out-of-phase and sensors at the top of the array can be used to detect the upper edge of the coin to determine diameter.

Figure 15:
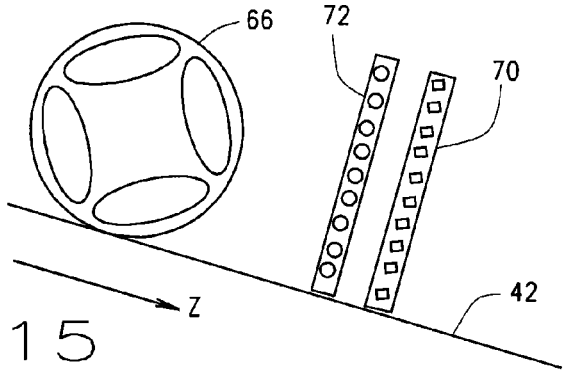
Figure 16:
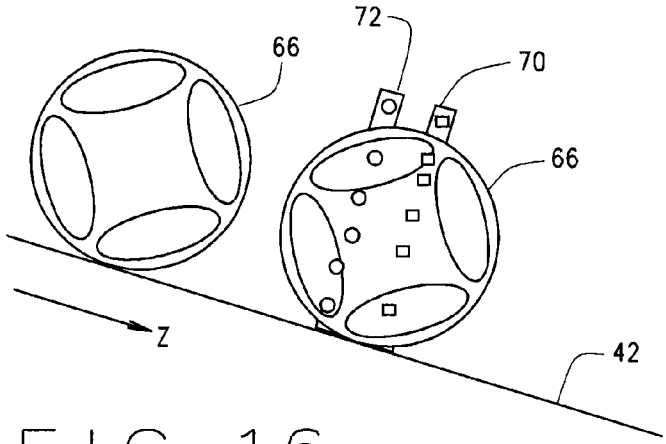

FIGS. 15 and 16 show schematically the same preferred embodiment of the present invention as presented in the FIGS. 11 and 12 with coin 66 passing the sensor arrays 70, 72 arranged in the vertical orientation of FIGS. 13 and 14.

Figure 17:
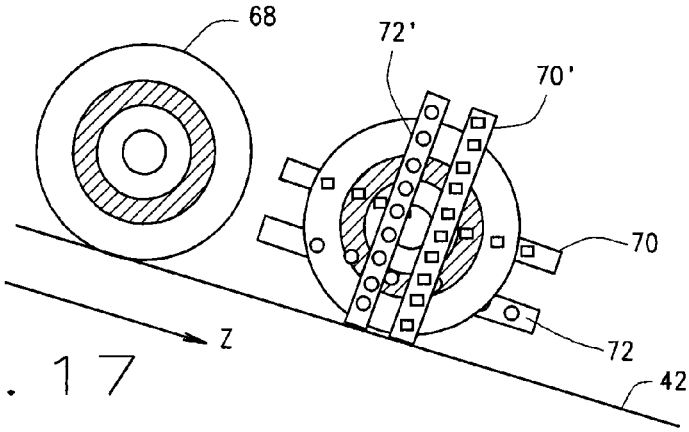
Figure 18:
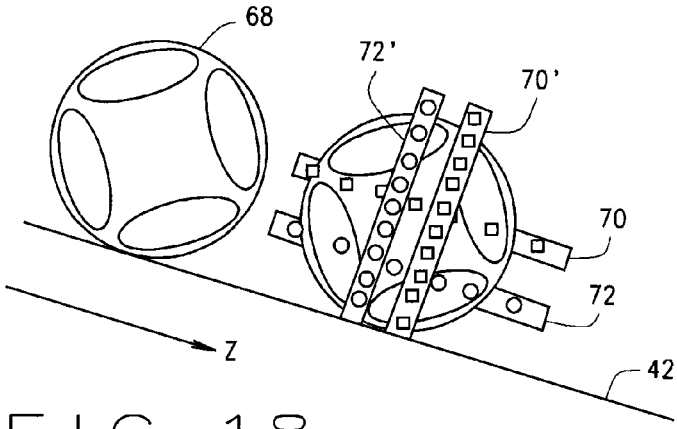

FIG. 17 and FIG. 18 show schematically a further embodiment of the present invention with two different types of coins 66, 68 rolling down the coin path 42 and arriving in the proximity of optical sensor array 70 and 70' and electromagnetic sensor array 72 and 72'. In this embodiment, vertical and horizontal optical sensor arrays 70 and 70' and magnetic sensor arrays 72 and 72' interact with the coins 66 and 68. In this embodiment, the waveforms of the embodiments of FIGS. 9 & 13 and 11 & 15 are all created such that more information about the coin may be analyzed.

Figure 19:
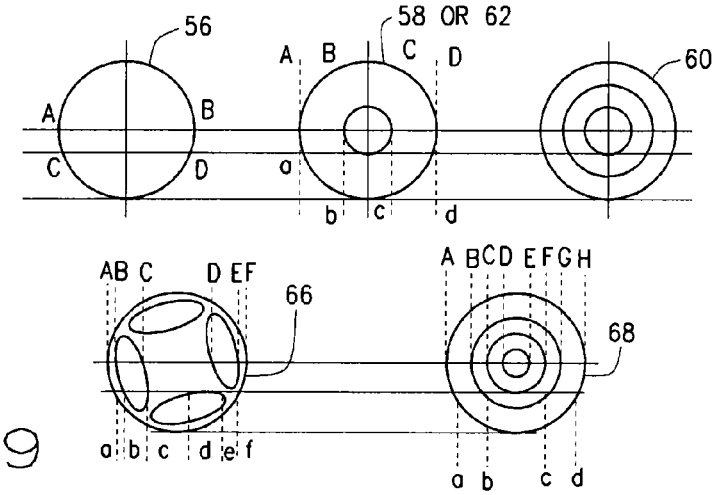
FIG. 19 is a schematic representation of different types of coins physical parameters that can be measured on each coin according to an embodiment of the present invention.
Figure 20:
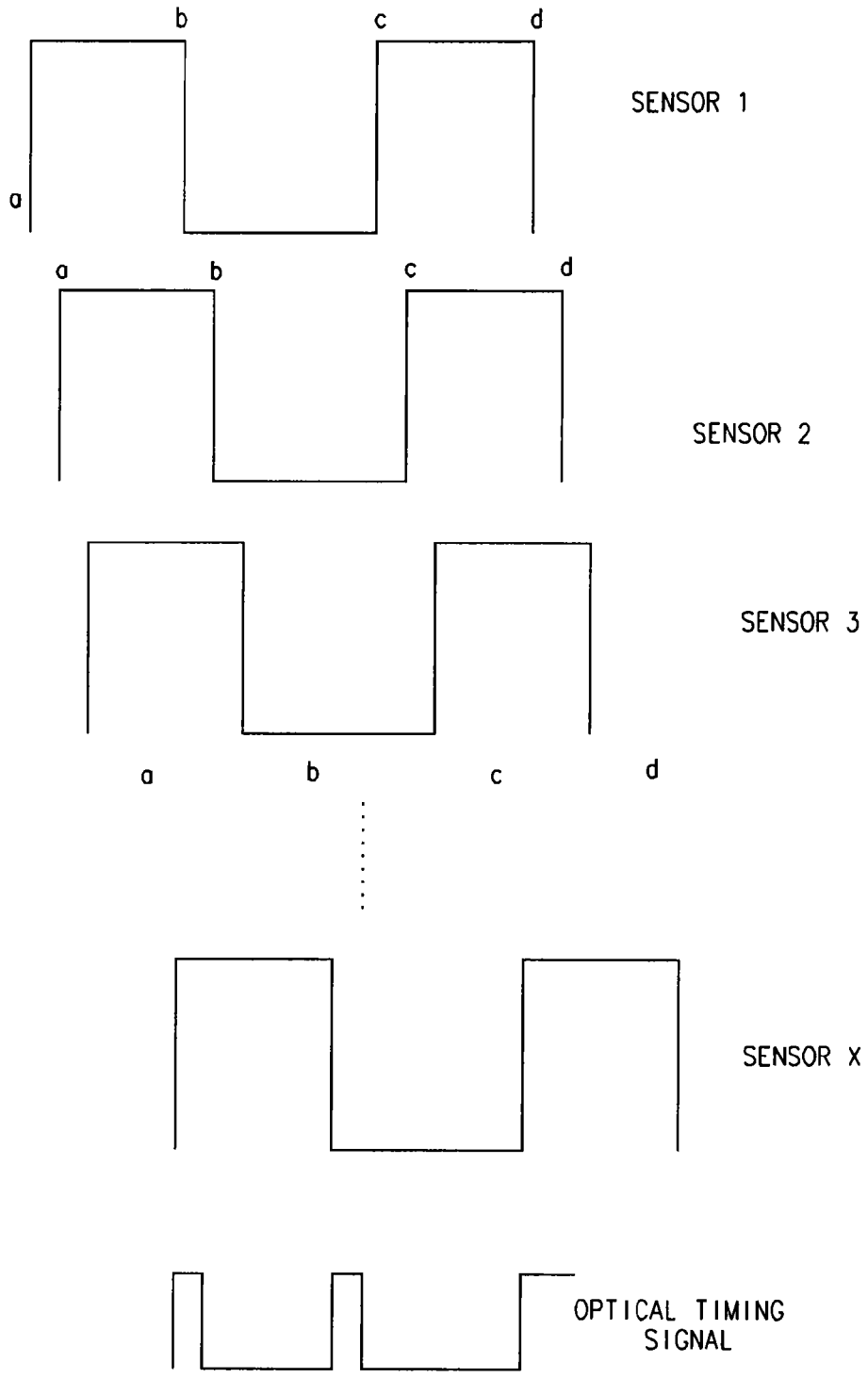
FIG. 20 is a diagram showing the optical timing signal according to an embodiment of the present invention.

FIG. 19 shows schematically the physical parameters that are measured on different coins using the preferred embodiments above. With reference now to FIG. 19, coin 56 is a solid coin for which the processor 35 will receive waveform information and will calculate at least diameters A-B and C-D and also many chords parallel with these two diameters. The diameters and the chords will be calculated based on optical sensors outputs and magnetic sensors outputs as described above. The processor 35 will finally compare the optical and magnetic calculated diameters and chords with pre-stored magnetic and optical diameters and decide if the coin 56 is valid and of what denomination.

Coin 58 or coin 62 defines either an aperture or comprises bi-alloy composition wherein the center material is either opaque or transparent. The center hole may also contain an electronic chip. For the case that the coin has a hole or a hole filled with a transparent substance, the processor 35 would implement the waveforms, as described above, to determine diameters A-D and E-F, diameter of the hole B-C, ring chords A-B, C-D. The processor will finally compare the optical and magnetic calculated diameters and chords with pre-stored magnetic and optical diameters and decide if the coin 58 or 62 is valid and of what denomination.

Similarly for coin 60, the processor 35 uses the optical and magnetic waveforms transmitted from the optical and magnetic sensor arrays 70, 72 to calculate the diameter of the coin 60, diameters of the two rings, diameters of the center hole, rings chords, center hole chords. The processor 35 will finally compare the optically and magnetically calculated diameters and chords with pre-stored magnetic and optical diameters and decide if the coin is valid and of what denomination.

The processor 35 uses the optical and magnetic waveforms transmitted from the optical and magnetic sensor arrays 70 and 72 to determine the diameter of the coin 68, diameters of the two solid rings 4 and 2, diameter of the transparent ring 1, diameters of the center hole, rings chords, center hole chords. The processor 35 will finally compare the optical and magnetic calculated diameters and chords with pre-stored magnetic and optical diameters and decide if the coin is valid and of what denomination.

Referring to FIGS. 17-19, due to the ringed construction of the coins 58 or 62, 60, 66 and 68 the ring portions will interact differently with the optical coin sensing devices in the horizontal optical and electromagnetic sensors arrays 70 and 72 than the vertical optical and electromagnetic sensors arrays 70' and 72'. With reference now to FIGS. 17 and 18 and in the case of the coin 66 of FIG. 19 rolling down the coin path 42, during the portions a-b, c-d, optical sensors in the horizontal array 70 will be blocked and they will be open during the portion b-c when they see the transparent portion of the coin. The signal generated by every one of the optical sensors in array 1 is transferred to the processor 35 via the interface and logic circuits 32 and 34 of FIG. 5. The processor 35 will further calculate optical sizes for the ring portions scanned by the optical sensors of the horizontal array 70. At the same time the magnetic sensors of the vertical electromagnetic array 72' will interact differently with the ring portions of the coin based on the material content of those portions. The signal generated by every one of the magnetic sensors is transferred to the processor 35 via the interface and logic circuits 32 and 34 of FIG. 5. The processor will further calculate "magnetic" sizes for the ring portions scanned by the magnetic sensors of horizontal electromagnetic array 72. Using these waveforms, the processor 35 will calculate optical and magnetic sizes for every ring and hole portion of the coin 66 scanned by the sensors. Furthermore the processor 35 will calculate ratio of the magnetic to optical sizes for all the calculated dimensions of the coin, coin rings and coin holes. Finally, the processor 35 compares these measurements with pre-stored data and decides if the coin is real and of what denomination.

Referring to FIGS. 9, 10, 13 and 17, with coin 68 of FIG. 19 rolling down the track and positioned in the proximity of the horizontal sensor arrays 70 and 72, intermediate optical sensors within vertical optical sensor array 70' of FIG. 9 will be located in the transparent ring portion b-c of the coin 68. All of the other optical sensors within vertical optical sensor array 70' interact with the solid portion of the coin 68. The processor 35 will generates an optical timing event signal when individual optical sensors in the array 70' go from OFF to ON when a solid portion of the coin 68 follows a transparent portion of the coin 68 and when a transparent portion of the coin 68 ends and a solid portion of the coin 68 follows. This optical timing event signal is unique for the given coin as it moves along the optical array. The processor 35 will compare the optical timing event signal with pre-stored optical timing events and decide if the coin is valid and of what denomination.

It will be apparent to those skilled in the art that many changes, modifications, variations, and other uses of the subject coin detection device are possible and contemplated. All changes, modifications, variations, and other uses and applications which do not depart from the spirit and scope of the invention are deemed to be covered by the invention, which is limited only by the claims which follow.

The invention claimed is:

1. A coin detection device for determining a size of a coin and a size of at least one aperture hole in the coin while the coin is traveling along a coin track, the device comprising a first inductive sensor array positioned along the coin track, a first optical sensor array positioned along the coin track, a processing circuit connected to the optical and inductive sensor arrays, each of the optical and inductive sensor arrays providing an output signal to the processing circuit and the processing circuit determining a size of the coin and a size of at least one aperture hole in the coin based upon output signal from each of the optical and inductive sensor arrays;

wherein the processing circuit is adapted to determine the validity of the coin by calculating the size of the coin and also calculating the size of the aperture hole; and wherein the size of the coin is a size of a chord of the coin, the size of said aperture hole is a size of a chord of the aperture hole and a mathematical operation is a ratio of the chord of the coin and the chord of the hole.

2. The device of claim 1 wherein the inductive sensor array and the optical sensor array are positioned one above the other and parallel to the coin track.

3. The device of claim 2 wherein the inductive sensor array and the inductive sensor array are each positioned perpendicular to the coin track.

4. The device of claim 1 wherein the optical sensor array and the inductive sensor array are each positioned perpendicular to the coin track.

5. The device of claim 4 further comprising a second inductive sensor array positioned at a relative angle to the first inductive sensor array.

6. The device of claim 4 further comprising a second optical sensor array positioned at a relative angle to the first inductive sensor array.

7. The device of claim 1 wherein the processing circuit is adapted to determine the validity of the coin by comparing the determined size and aperture hole size to values within a table stored within the processing circuit.

8. The device of claim 1 wherein at least one aperture hole in the coin is filled with an optically transparent material.

9. The device of claim 1 wherein at least one aperture hole in the coin is filled with a magnetically transparent material.

10. The device of the claim 9 wherein said aperture hole is filled with a magnetically or optically transparent material and comprises a ring of the coin.

11. The coin detection device of claim 1 wherein the processing circuit is adapted to validate a coin by comparing the calculated ratio value with a pre-stored value within the processing circuit.

12. The coin detection device of claim 11 where inductive sensors of the inductive sensor arrays when intercepted by the edges of the coin and by the edges of the holes in the coin generate an inductive timing event signal that is transmitted to the processing circuit.

13. The coin detection device of claim 1 wherein the coin comprises a token.

* * * * *